United States Patent [19]

Hashimoto

[11] 4,374,356

[45] Feb. 15, 1983

[54] CONSTANT VOLTAGE CIRCUIT

[75] Inventor: Masaru Hashimoto, Ayase, Japan

[73] Assignee: Tokyo Shibaura Denki Kabushiki Kaisha, Kawasaka, Japan

[21] Appl. No.: 298,104

[22] Filed: Aug. 31, 1981

Related U.S. Application Data

[63] Continuation-in-part of Ser. No. 284,671, Jul. 20, 1981, abandoned, which is a continuation of Ser. No. 68,401, Aug. 21, 1979, abandoned.

[30] Foreign Application Priority Data

Sep. 4, 1978 [JP] Japan ..... 53-108326

[51] Int. Cl.[3] ..... G05F 1/56

[52] U.S. Cl. ..... 323/273; 323/315

[58] Field of Search ..... 323/269, 273, 311-315

[56] References Cited

FOREIGN PATENT DOCUMENTS 55-34771 3/1980 Japan ..... 323/273

423111 9/1974 U.S.S.R. .

562804 10/1977 U.S.S.R. .

682887 8/1979 U.S.S.R. ..... 323/269

*Primary Examiner*—William H. Beha, Jr.

*Attorney, Agent, or Firm*—Oblon, Fisher, Spivak, McClelland & Maier

[57] ABSTRACT

A constant voltage circuit having an input voltage applied to input terminals, and which generates a constant voltage at its output terminals, wherein a first transistor is connected between one input terminal and one output terminal with the base of the first transistor connected through a second transistor to the other input terminal. A current related to the input voltage is applied to a connecting point between the first and second transistors. A first current path is constituted between the input terminal and the output terminal, and a second current path is connected to the connecting point and passes a current in response to the current in the first current path.

6 Claims, 4 Drawing Figures

CONSTANT VOLTAGE CIRCUIT

This application is a continuation-in-part of U.S. Patent Application Ser. No. 284,671 filed July 20, 1981, which is a continuation application of Ser. No. 068,401, filed Aug. 21, 1979, both applications now abandoned.

BACKGROUND OF THE INVENTION

1. Field of the Invention

This invention relates to a constant-voltage circuit for generating a stable constant voltage even if an input voltage is changed by various external effects.

2. Description of the Prior Art

Generally, it is desirable to derive a constant-voltage circuit which generates a stable constant voltage even if an input voltage is changed, and which itself consumes little current.

A prior constant-voltage circuit is showed in FIG. 1. In this circuit, an input voltage is supplied to input terminals 1 and 2, and a constant output voltage is derived from output terminals 3 and 4. NPN transistor 5 is connected in series between the terminals 1 and 3, with the collector NPN transistor 5 connected to the input terminal 1, and the emitter thereof connected to the output terminal 3. A collector of NPN transistor 6 is connected to a base of the transistor 5, and an emitter of transistor 6 is connected through constant-voltage diodes 7 and 8 to a ground point. The collector of the transistor 6 is also connected to the input terminal 1 through a resistor 9. Resistors 10 and 11 are connected in series between the output terminals 3 and 4. The connecting point of resistors 10 and 11 is connected to a base of the transistor 6, and a negative feedback loop is constructed. A load 12 is connected between the output terminals 3 and 5. The base-emitter voltage $V_{BE}$ of the transistors 5 and 6 is assumed to equal the anode-cathode voltage of diodes 7 and 8. Generally, the circuit is constructed on one semiconductor chip. In this case, diodes 7 and 8 are constructed by connecting a collector and a base of a transistor in common. So, the anode-cathode voltage of the diode is equal to the base-emitter voltage $V_{BE}$ of the transistor.

The output voltage $V_O$ in this circuit is given by $$V_O = 3V_{BE} \cdot \frac{R_{10} + R_{11}}{R_{11}} \quad (1)$$

where $V_{BE}$ is a base-emitter voltage of a transistor or an anode-cathode voltage of the diode, $R_{10}$ is the value of the resistor 10, and $R_{11}$ is the value of the resistor 11. The value of the base-emitter voltage $V_{BE}$ of the transistor in the equation (1) varies in response to the flowing current. In this circuit, the value of $V_{BE}$ is determined by the current $I_1$ in the resistor 9. The value of $I_1$ in the resistor 9 is given by $$I_1 = \frac{V_i - (V_O + V_{BE})}{R_9} \quad (2)$$

where $R_9$ is the value of resistor 9. Thus, in this circuit the value of I severely varies in response to the fluctuation of the input voltage $V_i$. So the output voltage $V_O$ likewise severely varies in response to the input voltage $V_i$ from the equation (1).

Now it is assumed that the constant-voltage output $V_O$ of 5 volts is derived by the input voltage $V_i$ of 8 volts, and the input voltage $V_i$ is changed from 8 volts to 15 volts. The fluctuation of the output voltage in this case is calculated as follows. Now the standard voltage value of the base-emitter voltage $V_{BE}$ of the transistor is about 0.7 volts. So the value of $(R_{10}+R_{11})/R_{11}$ must be equal to 2.38 from the equation (1). And the current $I_1$ of the equation (2) is 2.3 volts/$R_9$.

Next, the case that the input voltage $V_i$ is changed to fifteen volts is calculated. The current $I_1$ is 9.3 volts/$R_9$ from the equation (2). So the current in the diodes 7 and 8 and the collector current in the transistor 6 is changed from 2.3 volts/$R_9$ to 9.3 volts/$R_9$.

Generally, the fluctuation of the voltage $V_{BE}$ is calculated from an equation of diffusion potential as follows:

$$\Delta V_{BE} = \frac{KT}{q} \ln \frac{I_o}{I_o} \quad (3)$$

Where $I_O$ is the first value of the collector current of the transistor, k is Boltzman constant, q is charge value of an electron, and T is absolute temperature. In this case, the fluctuation $\Delta V_{BE}$ of the base-emitter voltage $V_{BE}$ is equal to 36.32 mV at room temperature. So the fluctuation of the output voltage $V_O$ becomes 259 mV from the equation (1).

As the base-emitter voltage $V_{BE}$ is 0.736 V ($V_{BE}$=0.7 V+0.036 V), in case that the input voltage $V_i$ is 15 V, the fluctuation $\Delta V_{BE}$ of the base-emitter voltage $V_{BE}$ becomes 36.32 mV from the equation (1) at room temperature. Thus the fluctuation of the input voltage $V_i$ influences the output voltage $V_O$ largely.

The current $I_1$ in the resistor 9 becomes larger from the equation (2) so that the difference between the input voltage $V_i$ and the output voltage $V_o$ becomes larger. As this current flows to ground through the transistor 6, the current consumed in the circuit is increased unnecessarily.

Another prior art constant voltage circuit is shown in FIG. 2, where the resistor 9 is replaced by the transistor 13 which operates as a constant-current source. So, as the value of the base-emitter voltage $V_{BE}$ is kept nearly constant, the output voltage $V_O$ is kept more constant. But this circuit has disadvantages, as follows. This circuit requires a special starting circuit because all transistors 5, 6, 13, 14 and 15 are off when the input voltage $V_i$ starts from zero volt such that the circuit of the transistors 5, 6, 13, 14 and 15 constitute a positive feedback circuit. A resistor 16, a diode 17, a transistor 18 and a resistor 19 constitute a circuit for starting. As the current in the transistor 6, the diodes 7 and 8 are determined by $V_{BE}/R_{19}$ the current is kept nearly constant. However, this current flows to the ground and represents lost power. Thus, although this circuit producers a constant voltage, the circuit is highly complex and wastefully consumes larger amounts of current.

SUMMARY OF THE INVENTION

Accordingly, an object of the invention is to provide a constant-voltage circuit for producing a constant voltage output independent of large input voltage fluctuations.

Another object of the invention is to provide a constant-voltage circuit in which current consumption is minimized.

Another object of the invention is to provide a constant-voltage circuit having few circuit elements and which does not require a special circuit for starting.

According to the invention, there is provided a constant-voltage circuit comprising first and second input terminals for supplying an input voltage, first and second output terminals for outputting a constant voltage, a first transistor having a collector connected to the first input terminal and an emitter connected to the first output terminal, a second transistor which is connected between the base of the first transistor and the second input terminal, means for outputting a voltage relative to a PN junction voltage of the second transistor, means for applying a current in response to the input voltage to a connecting point of the first transistor and the second transistor, a first current path constituted between the first input terminal and the output terminal, and a second current path for passing a current in response to the current of the first current path, wherein the second current path is connected to the applying means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
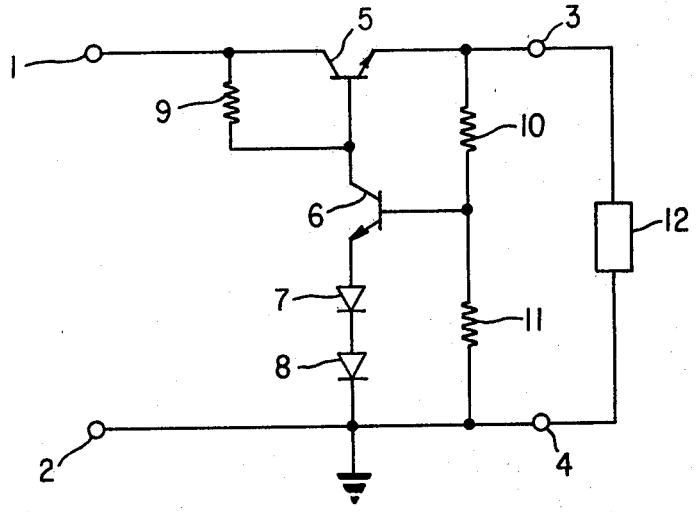
FIG. 1 (PRIOR ART)
FIG. 1 is a circuit diagram of a prior art constant-voltage circuit.
Figure 2:
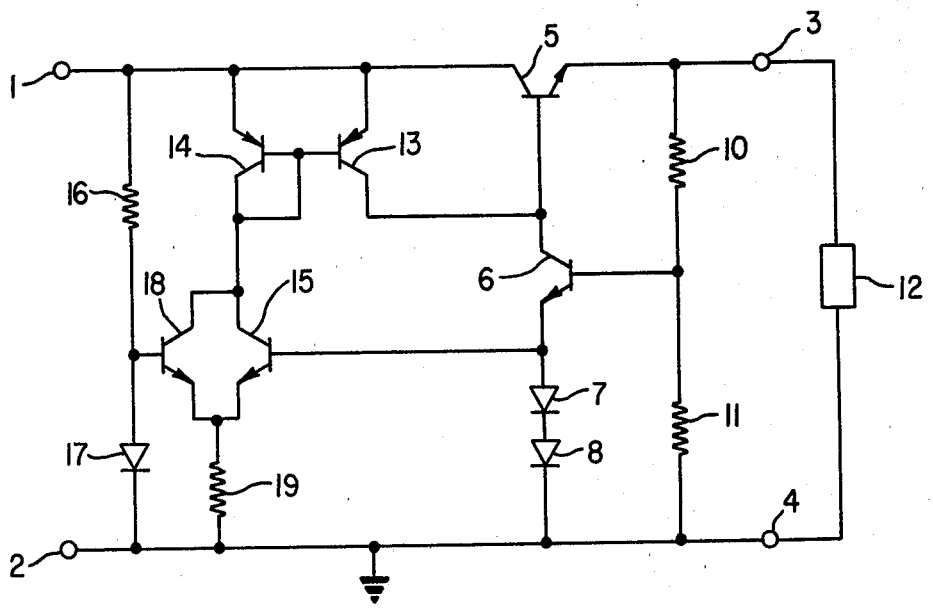
FIG. 2 (PRIOR ART)
FIG. 2 is a circuit diagram of another prior art constant-voltage circuit.
Figure 3:
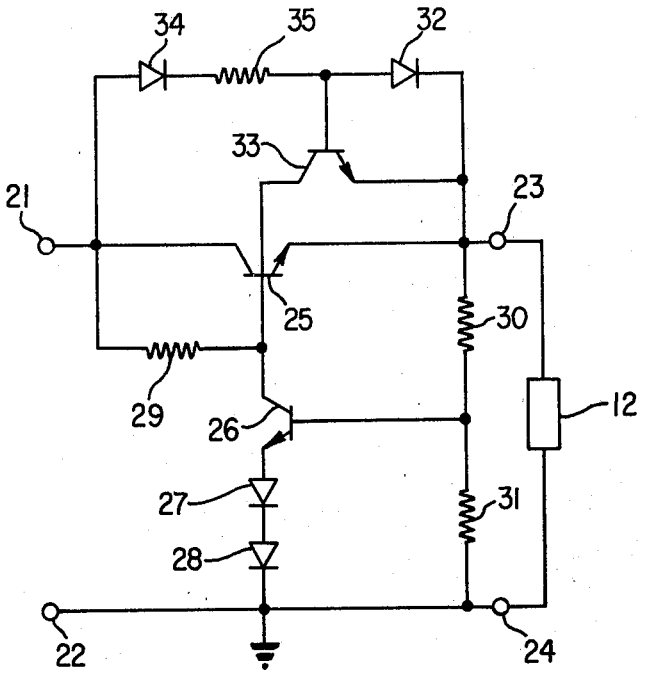
FIG. 3 is a circuit diagram of an embodiment of the invention.

Referring now to the drawings, wherein like reference numerals designate identical or corresponding parts throughout the several views, and more particularly to FIG. 3 thereof, an input voltage is applied to input terminals 21 and 22 and a constant voltage is produced at output terminals 23 and 24. A collector of NPN transistor 25 is connected to the input terminal 21, and an emitter thereof is connected to the output terminal 23. NPN transistor 26, and diodes 27 and 28 are connected in series between the base of the transistor 25 and ground. The collector of the transistor 25 is connected to the input terminal 21 through a resistor 29, while the base of transistor 25 is connected to a connecting point of resistors 30 and 31 which are serially connected between the output terminals 23 and 24. A diode 32 and NPN transistor 33 constitute a current mirror circuit which is a feature of the invention. The base of the transistor 33 is connected to the input terminal 21 through a diode 34 and a resistor 35. The collector of the transistor 33 is connected to a collector of the transistor 26. The current in response to the input current of the current mirror circuit flows between the collector and the emitter of the transistor 33. A connecting point of a cathode of the diode 32 and the emitter of the transistor 33 is connected to the output terminal 23. A stable constant load voltage $V_O$ is obtained by this construction, such that the $V_O$ is not changed even if the input voltage $V_I$ fluctuates.

Next the fluctuation of the output voltage $V_O$ in this circuit is calculated. A current $I_{11}$, which determines the base-emitter voltage $V_{BE}$ of the transistor 26, flowing in the transistor 26, the diodes 27 and 28 is calculated as follows. In this case, the base current of the transistor 26 is neglected. A current $I_{22}$ in the resistor 35 is given by $$I_{22} = \frac{(V_I - V_{BE}) - (V_O + V_{BE})}{R_{35}} \quad (4)$$

where $R_{35}$ represents the value of the resistor 35. A current $I_{33}$ in the resistor 29 is given by $$I_{33} = \frac{V_I - (V_O + V_{BE})}{R_{29}} \quad (5)$$

where $R_{29}$ represents the value of the resistor 29. The current $I_{33}$ forms the collector current of the transistor 26 and the collector current of the transistor 33. If the diode 32 has the same conductance as the transistor 33, the collector current of the transistor 33 is equal to the current $I_{22}$. So the current $I_{11}$ is given by $$I_{11} = I_{33} - I_{22} = \frac{V_{BE}}{R_{29}} = \frac{V_{BE}}{R_{35}} \quad (6)$$

where $R_{29}$ will be predetermined to be equal to $R_{35}$. Therefore, the current $I_{22}$ in the diode 32 is equal to the collector current of the transistor 33 so that the diode 32 and the transistor 33 constitute a current-mirror circuit. This current $I_{11}$ fluctuates in response to the base-emitter voltage $V_{BE}$ of the transistor. But the rate of the fluctuation is very small compared with that of the current $I_1$ defined by the equation (2). So the fluctuation of the base-emitter voltage $V_{BE}$ becomes small. This makes the output voltage $V_O$ defined by the equation (1) stable and constant.

In the above equation (6), $V_{BE}$ is the base-emitter voltage of transistors 33 and 25. The collector current of transistor 33 is substantially determined by the base-emitter voltage of the transistor 33, based on the forward voltage across the PN junction of diode 32 and the resistance of resistor 35. Furthermore, the currents flowing through transistor 33 and diode 32 are proportional to the ratio of the emitter sizes thereof. Since the emitter sizes of the transistor 33 and the diode 32 are changeable at predetermined values, the current flowing therethrough, which is proportional to the respective emitter sizes, are likewise proportional. Namely, when the emitter size ratio of the transistor 33 and the diode 32 is 1:2, the ratio of the current flowing through becomes 1:2.

The fluctuation of output voltage $V_O$ due to that of the input voltage $V_I$ can be concretely expressed by the following. There will be described the calculation of the case that the input voltage $V_I$ changes from 8 volts to 15 volts and the designer wants to obtain the output voltage of 5 volts. The value of $(R_{30}+R_{31})/R_{31}$ of the equation (1) is determined to be 2.38, as is standard from the equation (1). The current $I_{22}$ is given by $$I_{22} = \frac{V_I - V_O - 2V_{BE}}{R_{35}}$$

$$= \frac{8V - 5V - 2V_{BE}}{R_{35}}$$

$$= \frac{1.6\,V}{R_{35}}$$

-continued $$= \frac{1.6\ V}{R_{29}}$$

wherein the input voltage $V_i$ is 8 volts. When the input voltage $V_i$ fluctuates to 15 volts, the current $I'_{22}$ becomes as follows:

$$= \frac{V_{in} - V_O - 2V_{BE}}{R_{35}}$$

$$= \frac{15V - 5V - 2V_{BE}}{R_{35}}$$

$$= \frac{8.6\ V}{R_{35}}$$

$$= \frac{8.6\ V}{R_{29}}$$

and the fluctuation $V_{BE}$ of the base-emitter voltage $V_{BE}$ is defined by the equation (3). So it is given by $$\Delta V_{BE} = \frac{kT}{q} \ln \frac{I'_o}{I_o}$$

$$= 43.7\ mV$$

So the fluctuation $\Delta I_{11}$ of the current $I_{11}$ in the diodes 27 and 28 is given by $$\Delta I_{11} = \frac{V_{BE}}{R_{29}}$$

$$= \frac{43.7\ mV}{R_{29}}$$

Next the fluctuation $\Delta V_{BE}$ of the transistor 26, the diodes 27 and 28 is given by $$\Delta V_{BE} = \frac{kT}{q} \ln \frac{I'_{11}}{I_{11}}$$

$$= \frac{kT}{q} \ln \frac{43.7\ mV/R_{29} + 1.6\ V/R_{29}}{1.6\ V/R_{29}}$$

$$= 0.7\ mV$$

So the output voltage $V_O$ is given by $$V_O = 3V_{BE} \times \frac{R_{30} + R_{31}}{R_{31}}$$

$$= 3 \times (0.7 + 0.0007) \times 2.38\ V$$

$$= 5.005\ V$$

where $R_{30}$ represents the value of the resistor 30 and $R_{31}$ represents the value of the resistor 31. As described above, the fluctuation of the output voltage $V_O$ becomes 0.005 V. This is very small compared with a prior art circuit.

Figure 4:
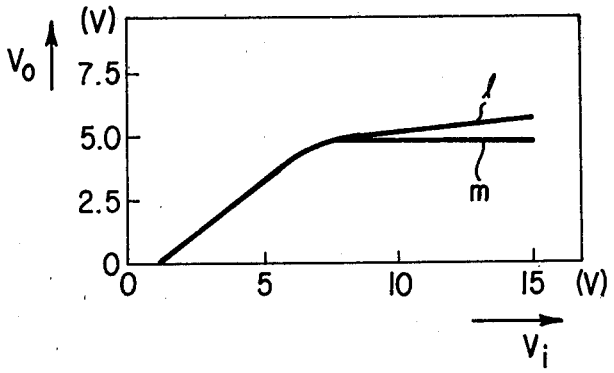
FIG. 4 is a characteristic curve comparing a voltage fluctuation of a circuit of the invention with that of a prior art circuit.

FIG. 4 shows the fluctuation of the output voltage $V_O$ due to that of the input voltage $V_i$. In this FIGURE, "l" represents a characteristic curve of a prior art circuit and "m" represents the characteristic curve of the circuit of the invention. As shown in FIG. 4, the circuit of this invention produces a stable constant voltage having a very small fluctuation.

Further, in the circuit shown in FIG. 3, the current in the resistor 35 and the collector current in the transistor 33 are not wastefully consumed so that all of these currents flow to the output terminal 23. After all, the current $I_1$ is suppressed at low value even if the input voltage $V_i$ becomes higher and the difference of the input voltage $V_i$ and the output voltage $V_O$ becomes larger. Thus, the current consumed in the circuit can be suppressed to a low value.

In the circuit shown in FIG. 3, the current in the load 36 surely becomes larger than $2I_2$. So, when a load 36 is predetermined, this circuit always operates as a constant-voltage circuit by suitable assignment of values to the several circuit elements. In the event that the constant-voltage circuit supplies a load fabricated on the same semiconductor chip with constant circuit voltage, a loading having predetermined value surely is provided. Then, the circuit always operates as a stable constant-voltage circuit and the circuit of this invention does not cause trouble.

This invention is not limited to the above embodiment. The transistors 25, 26 and so on can be replaced by several transistors, for example connected in Darlington configuration. The current-mirror circuit constituted by the diode 32 and the transistor 33 can be replaced by other circuits. In that case the circuit requires a main current path for current flow of an input current and a mirror current path for the current related to the input current. Further, the mirror current path requires a connecting point to the main current path. Additionally, the transistors of the circuit can be replaced by PNP transistors, and the diodes 27 and 28 can be omitted. In this case, the value of the resistors 30 and 31 must be selected suitably. Also, the connection of the circuit does not always require a direct connection.

Thus, according to this invention the stable constant voltage can be obtained even if the input voltage fluctuates, and the waste current consumed in the circuit is significantly reduced. Furthermore, the circuit of this invention is highly amenable for fabrication on one semiconductor chip as an integrated circuit.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A constant-voltage circuit comprising:

first and second input terminals for supplying an input voltage;

first and second output terminals for outputting a constant voltage;

a first transistor having a base, a collector connected to the first input terminal, and an emitter connected to the first output terminal;

a second transistor having a base, and collector and emitter connected between the base of the first transistor and the second input terminal;

means for applying a current in response to the input voltage to a connecting point of the first and second transistors;

a current mirror circuit comprising, a series circuit including at least a resistive means and a PN junction portion connected in series across the first input terminal and the first output terminal to form a first current path therebetween;

a third transistor having a base connected to the interconnection between the resistive means and the PN junction portion of said first current path, and emitter and collector terminals connected between the connection point of said first and second transistors and said first output terminal to form a second current path which is also connected to the said applying means, and said PN junction portion of said first current path connected across the base and emitter of said third transistor and having a conductance substantially equal to that of the conductance of said third transistor such that the current flowing through said PN junction portion of said series circuit is substantially equal to the current flowing through said collector of said third transistor;

output sensing means connected to said output terminals for applying a signal proportional to the voltage across said output terminals to the base of said second transistor, thereby stabilizing an output voltage across said first and second output terminals in relation to variation of an input voltage across said first and second input terminals.

2. A constant voltage circuit according to claim 1, further comprising:

said first current path including another PN junction portion connected in series with the resistive means thereof between the first input terminal and the base of said third transistor, and said applying means comprising a resistor having a resistance equal to the resistance of said resistive means of said first current path.

3. A constant-voltage circuit according to claim 1 wherein a base of the second transistor is connected to a connecting point of two resistors connected in series between the first and second output terminals.

4. A constant-voltage circuit according to claim 1, wherein all elements of the circuit are constructed on one semiconductor chip.

5. A constant-voltage circuit comprising:

first and second input terminals for supplying an input voltage;

first and second output terminals for outputting a constant voltage;

a first transistor having a base, a collector connected to the first input terminal, and an emitter connected to the first output terminal;

a second transistor having a base, and collector and emitter connected between the base of the first transistor and the second input terminal;

means for applying a current in response to the input voltage to a connecting point of the first and second transistors;

a current mirror circuit comprising, a series circuit including at least a resistive means and a PN junction means connected in series across the first input terminal and the first output terminal to form a first current path therebetween;

a third transistor having a base connected to the interconnection between the resistive means and the PN junction means of said first current path, and emitter and collector terminals connected between the connection point of said first and second transistors and said first output terminal to form a second current path which is also connected to the said applying means, and said PN junction means of said first current path connected across the base and emitter of said third transistor;

output sensing means connected to said output terminals for applying a signal in response to the voltage across said output terminals to the base of said second transistor, whereby an output voltage across said first and second output terminals is stabilized in relation to variation of an input voltage across said first and second input terminals.

6. A constant-voltage circuit comprising:

first and second input terminals for supplying an input voltage;

first and second output terminals for outputting a constant voltage;

a first transistor having a base, a collector connected to the first input terminal, and an emitter connected to the first output terminal;

a second transistor having a base, and collector and emitter connected between the base of the first transistor and the second input terminal;

means for applying a current in response to the input voltage to a connecting point of the first and second transistors;

a current mirror circuit comprising;

a series circuit including at least a resistive means and a PN junction portion connected in series across the first input terminal and the first output terminal to form a first current path therebetween;

a third transistor having a base connected to the interconnection between the resistive means and the PN junction portion of said first current path, and emitter and collector terminals connected between the connection point of said first and second transistors and said first output terminal to form a second current path which is also connected to the said applying means, and said PN junction portion of said first current path connected across the base and emitter of said third transistor wherein the conductance of said PN junction portion and that of said third thyristor are selected such that the current flowing through said PN junction portion of said series circuit is substantially equal to the current flowing through said collector of said third transistor;

output sensing means connected to said output terminals for applying a signal proportional to the voltage across said output terminals to the base of said second transistor;

whereby the collector current of said second transistor is substantially determined by a forward voltage across said PN junction portion and the resistance of laid resistive means of said first current path, thereby stabilizing an output voltage across said first and second output terminals in relation to variation of an input voltage across said first and second input terminals.

* * * * *